US008818798B2

(12) United States Patent
Beerends et al.

(10) Patent No.: US 8,818,798 B2
(45) Date of Patent: Aug. 26, 2014

(54) METHOD AND SYSTEM FOR DETERMINING A PERCEIVED QUALITY OF AN AUDIO SYSTEM

(75) Inventors: John Gerard Beerends, Hengstdijk (NL); Jeroen van Vugt, The Hague (NL)

(73) Assignees: Koninklijke KPN N.V., The Hague (NL); Nederlandse Organisatie voor Toegepast-Natuurwetenschappelijk Onderzoek TNO, Delft (NL)

( * ) Notice: Subject to any disclaimer, the term of this patent is extended or adjusted under 35 U.S.C. 154(b) by 268 days.

(21) Appl. No.: 13/390,221

(22) PCT Filed: Aug. 9, 2010

(86) PCT No.: PCT/EP2010/061542

§ 371 (c)(1),
(2), (4) Date: Feb. 13, 2012

(87) PCT Pub. No.: WO2011/018430

PCT Pub. Date: Feb. 17, 2011

(65) Prior Publication Data

US 2012/0143601 A1 Jun. 7, 2012

(30) Foreign Application Priority Data

Aug. 14, 2009 (EP) ..... 09010501
May 4, 2010 (EP) ..... 10161830

(51) Int. Cl.
*G10L 21/00* (2013.01)
*G10L 19/00* (2013.01)
*G10L 25/69* (2013.01)

(52) U.S. Cl.
CPC ..... *G10L 25/69* (2013.01)
USPC ..... 704/225; 704/200.1; 704/224

(58) Field of Classification Search
None
See application file for complete search history.

(56) References Cited

U.S. PATENT DOCUMENTS 7,302,234 B1 * 11/2007 Fessler et al. ..... 455/67.13
7,313,517 B2 12/2007 Beerends et al.

(Continued)

FOREIGN PATENT DOCUMENTS

EP 1975924 A1 10/2008
EP 2048657 A1 4/2009

OTHER PUBLICATIONS

"Series P: Telephone Transmission Quality, Telephone Installations, Local Line Networks/Methods for Objective and Subjective Assessment of Quality/Objective Quality Measurement of Telephone-Band (300-3400 Hz) Speech Codecs", ITU-T Recommendation P.861, (Feb. 1998), 43 pages.

(Continued)

*Primary Examiner* — Jesse Pullias
(74) *Attorney, Agent, or Firm* — McDonnell Boehnen Hulbert & Berghoff LLP

(57) ABSTRACT

The invention relates to a method for determining a quality indicator representing a perceived quality of an output signal of an audio system with respect to a reference signal. The reference signal and the output signal are processed and compared. The processing includes dividing the reference signal and the output signal into mutually corresponding time frames, and includes scaling the intensity of the reference signal towards a fixed intensity level, and then performing measurements on time frames within the scaled reference signal for determining reference signal time frame characteristics. Further on, the loudness of the output signal is scaled towards a fixed loudness level in the perceptual loudness domain. Finally, the loudness of the reference signal is scaled from a loudness level corresponding to the output signal related intensity level towards a loudness level related to the loudness level of the scaled output signal in the perceptual loudness domain.

11 Claims, 4 Drawing Sheets

(56) References Cited

U.S. PATENT DOCUMENTS

| | | | | |
|---|---|---|---|---|
| 7,315,812 | B2 | 1/2008 | Beerends | |
| 7,412,375 | B2 * | 8/2008 | Goldstein et al. | 704/200.1 |
| 7,526,394 | B2 * | 4/2009 | Reynolds et al. | 702/69 |
| 7,590,530 | B2 * | 9/2009 | Zhao et al. | 704/226 |
| 7,668,191 | B2 * | 2/2010 | Steinback et al. | 370/437 |
| 2004/0078197 | A1 * | 4/2004 | Beerends et al. | 704/225 |
| 2005/0159944 | A1 | 7/2005 | Beerends | |

OTHER PUBLICATIONS

"Series P: Telephone Transmission Quality, Telephone Installations, Local Line Networks/Methods for Objective and Subjective Assessment of Quality/Perceptual Evaluation of Speech Quality (PESQ): An Objective Method for End-to-End Speech Quality Assessment of Narrow-Band Telephone Networks and Speech Codecs", ITU-T Recommendation P.862, Feb. 2001, 30 pages.

Beerends, John G. et al., "A Perceptual Audio Quality Measure Based on a Psychoacoustic Sound Representation", J. Audio Eng. Soc., vol. 40, No. 12, 1992, pp. 963-978.

PCT International Search Report and Written Opinion, PCT International Application No. PCT/EP2010/061542 dated Nov. 18, 2010.

European Search Report, European Patent Application No. 09010501.6 dated Jan. 19, 2010.

Beerends, John G. et al., "Perceptual Evaluation of Speech Quality (PESQ) The New ITU Standard for End-to-End Speech Quality Assessment Part II—Psychoacoustic Model", J. Audio Eng. Soc., vol. 50, No. 10, Oct. 2002, pp. 765-778.

* cited by examiner

METHOD AND SYSTEM FOR DETERMINING A PERCEIVED QUALITY OF AN AUDIO SYSTEM

CROSS REFERENCE TO RELATED APPLICATIONS

The present application is a national stage entry of PCT/EP2010/061542, filed Aug. 9, 2010, and claims priority to EP 09010501.6, filed Aug. 14, 2009 and EP 10161830.4, filed May 4, 2010. The full disclosures of EP 09010501.6, EP 10161830.4, and PCT/EP2010/061542 are incorporated herein by reference.

FIELD OF THE INVENTION

The invention relates to a method for determining a quality indicator representing a perceived quality of an output signal of an audio system, for example a speech processing device, with respect to a reference signal. The invention further relates to a computer program product comprising computer executable code, for example stored on a computer readable medium, adapted to perform, when executed by a processor, such method. Finally, the invention relates to a system for determining a quality indicator representing a perceived quality of an output signal of an audio system with respect to an input signal of the audio system which serves as a reference signal.

BACKGROUND OF THE INVENTION

The quality of an audio device can be determined either subjectively or objectively. Subjective tests are time consuming, expensive, and difficult to reproduce. Therefore, several methods have been developed to measure the quality of an output signal, in particular a speech signal, of an audio device in an objective way. In such methods, the speech quality of an output signal as received from a speech signal processing system is determined by comparison with a reference signal.

A current method that is widely used for this purpose is the method described in ITU-T Recommendation P.862 entitled "Perceptual evaluation of speech quality (PESQ): An objective method for end-to-end speech quality assessment of narrow-band telephone networks and speech codecs". In ITU-T recommendation P.862, the quality of an output signal from a speech signal processing system, which signal is generally distorted, is to be determined. The output signal and a reference signal, for example the input signal of the speech signal processing system, are mapped onto representation signals according to a psycho-physical perception model of the human auditory system. Based on these signals, a differential signal is determined which is representative of distortion within the output signal as compared to the reference signal. A quality indicator representing a perceived quality of an output signal is commonly defined as an indicator which shows a high correlation with the subjectively perceived speech quality. The quality indicator is commonly expressed as a Mean Opinion Score (MOS) as determined in a subjective test where subjects (human) express their opinion on a quality scale. In general the quality indicator is derived from a comparison of the internal representation of the output signal of a device under test with the internal representation of the input signal to the device under test. The internal representation can be calculated by transforming the signal from the external, physical domain, towards the internal, psycho-physical domain. In ITU-T recommendation P.862 the core of the algorithm that is used in the calculation of the psycho-physical signal representation is composed of the following main operations, scaling towards a fixed level, time alignment, transformation from the amplitude-time to the power-time-frequency domain, warping of power and frequency scale. The operations lead to an internal representation in terms of loudness-time-pitch from which difference functions can be calculated. These difference functions are then used to derive a single quality indicator. For each speech file one can thus derive a MOS score and a quality indicator score which should have the highest possible correlation between them. As an example one can determine the quality of a speech codec by comparing the internal representations of the output of the codec with the internal representations of the input of the codec. For each speech file that is coded by the codec the quality indicator will produce a number that should have a high correlation with the subjectively determined MOS score for that en/decoded speech file. The differential signal is then processed in accordance with a cognitive model, in which certain properties of human hearing perception based on testing have been modeled, to obtain a quality signal that is a measure of the quality of the auditive perception of the output signal.

As clearly indicated by ITU-T recommendation P.862, PESQ is known to provide inaccurate predictions when used at varying listening levels. PESQ assumes a standard listening level of 79 dB SPL (Sonic Pressure Level) and compensates for non-optimum signal levels in the input signal. The subjective effect of deviation from optimum listening levels is therefore not taken into account. In present-day telecommunications systems, in particular systems using Voice-Over-IP (VOIP) and similar technologies, non-optimum listening levels occur very often. Consequently, PESQ frequently does not provide optimum predictions of the perception of speech signals processed in such telecommunication systems, which are becoming increasingly popular.

SUMMARY OF THE INVENTION

It is desired to have a method of determining the transmission quality of an audio system that provides an improved correlation between the speech quality as determined by objective measurement and speech quality as determined in subjective testing. For this purpose, an embodiment of the invention relates to a method for determining a quality indicator representing a perceived quality of an output signal of an audio system, for example a speech processing device, with respect to a reference signal, where the reference signal and the output signal are processed and compared, and the processing includes dividing the reference signal and the output signal into mutually corresponding time frames, wherein the processing further comprises: scaling the intensity of the reference signal towards a fixed intensity level; performing measurements on time frames within the scaled reference signal for determining reference signal time frame characteristics; scaling the intensity of the reference signal from the fixed intensity level towards an intensity level related to the output signal; scaling the loudness of the output signal towards a fixed loudness level in the perceptual loudness domain, the output signal loudness scaling using the reference signal time frame characteristics; and scaling the loudness of the reference signal from a loudness level corresponding to the output signal related intensity level towards a loudness level related to the loudness level of the scaled output signal in the perceptual loudness domain, the reference signal loudness scaling using the reference signal time frame characteristics.

In certain embodiments, scaling the intensity of the reference signal from the fixed intensity level towards an intensity level related to the output signal is based on multiplication of the reference signal with a scaling factor, the scaling factor being defined by: determining an average reference signal intensity level for a number of time frames; determining an average output signal intensity level for a number of time frames corresponding to the time frames of the reference signal used to determine the average reference signal intensity level; deriving a preliminary scaling factor by determining a fraction based on the average reference signal intensity level and the average output signal intensity level; determining a scaling factor by defining the scaling factor to be equal to the preliminary scaling factor if the preliminary scaling factor is smaller than a threshold value, and, being equal to the preliminary scaling factor incremented with an additional preliminary scaling factor dependent value otherwise.

In some embodiments of the invention, before the loudness scaling of the output level to a fixed loudness level, the method further comprises: locally scaling the loudness level of the reference signal towards the loudness level of the output signal for parts of the reference signal with a loudness level being higher than the loudness level of the output signal; and subsequently locally scaling the loudness level of the output signal towards the loudness level of the reference signal for parts of the output signal with a loudness level being higher than the loudness level of the reference signal. The separation of these local scaling actions allows for separate implementation and/or manipulation of level variations due to time clipping and pulses.

In some embodiments of the invention, the processing further comprises: transforming the scaled reference signal and the output signal from the time domain towards the time-frequency domain; deriving a reference pitch power density function from the reference signal, and deriving an output pitch power density function from the output signal, said intensity level difference corresponding to the difference between the intensity levels of the pitch power density functions; locally scaling the reference pitch power density function to obtain a locally scaled reference pitch power density function; partially compensating the locally scaled reference pitch power density function with respect to frequency; deriving a reference loudness density function and an output loudness density function, said loudness level difference corresponding to the difference between the loudness levels of the loudness density functions; wherein the loudness density functions represent density functions that enable quantification of the impact of variable level playback on perceived quality. In a further embodiment, the method further comprises performing an excitation operation on at least one of the reference pitch power density function and the output pitch power density function. Such excitation operation may allow for compensation of smearing of frequency components as a result of execution of the transforming action performed on these signals.

The processing may further comprise at least one of compensating the locally scaled reference pitch power density function with respect to frequency and compensating the locally scaled reference loudness density function includes estimating a linear frequency response of the speech processing system based on the reference signal time frame characteristics. For example, the mere use of time frames with an average intensity level exceeding a certain threshold may improve the performance of these actions.

In some embodiments of the invention, the reference signal in the perceptual loudness domain, before the scaling towards a loudness level related to the loudness level of the output signal in the perceptual loudness domain, is subjected to a noise suppression action for suppressing noise up to a predetermined noise level. The predetermined noise level may correspond to a noise level that is considered to be a desirable low noise level to serve as an ideal representation for the output signal. Similarly or additionally, the output signal in the perceptual loudness domain, before the scaling towards a fixed loudness level, may be subjected to a noise suppression algorithm for suppressing noise up to a noise level representative of disturbance. Noise suppression of the output signal may allow for suppressing noise up to a noise level representative of the disturbance experienced by the device under test.

In some embodiments of the invention, the reference signal and the output signal in the perceptual loudness domain, before comparison, are subjected to a global noise suppression. It has been found that such additional noise suppression after global scaling further improves the correlation between an objectively measured speech quality and the speech quality as obtained in subjective listening quality experiments.

In some embodiments of the invention, the invention further relates to a computer program product comprising computer executable code, for example stored on a computer readable medium, adapted to perform, when executed by a processor, any one of abovementioned method embodiments.

Finally, in some embodiments of the invention, the invention further relates to a system for determining a quality indicator representing a perceived quality of an output signal Y(t) of an audio system, for example a speech processing device, with respect to an input signal X(t) of the audio system which serves as a reference signal, the system comprising: a pre-processing device for pre-processing the reference signal and the output signal; a first processing device for processing the reference signal, and a second processing device for processing the output signal to obtain representation signals R(X), R(Y) for the reference signal and the output signal respectively; a differentiation device for combining the representation signals of the reference signal and the output signal so as to obtain a differential signal D; and a modeling device for processing the differential signal to obtain a quality signal Q representing an estimate of the perceptual quality of the speech processing system; wherein the pre-processing device, the first processing device, and the second processing device form a processing system for performing any one of the abovementioned method embodiments.

DETAILED DESCRIPTION OF EMBODIMENTS OF THE INVENTION

The following is a description of certain embodiments of the invention, given by way of example only.

Throughout the description, the terms "local" and "global" will be used with respect to an operation performed on a signal. A "local" operation refers to an operation performed on part of the time signal, for example on a single frame. A "global" operation refers to an operation performed on the entire signal.

Throughout the description, the terms "output" and "distorted" may be used in relation to a signal originating from an output of an audio system, like a speech processing device. Throughout the description, the terms "reference" and "original" may be used in relation to a signal offered as an input to the audio system, the signal further being used as a signal with which the output or distorted signal is to be compared.

Figure 1:
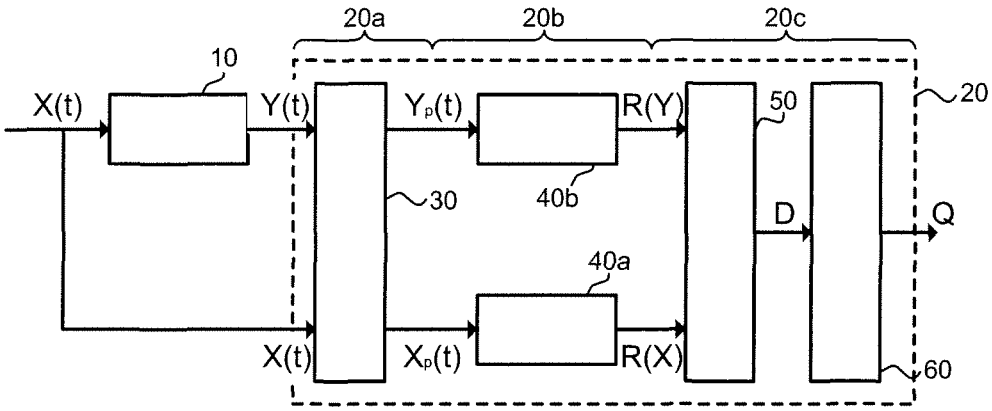
FIG. 1 schematically shows a general set-up including a system for determining a quality indicator representing a perceived quality of an output signal of an audio system with respect to a reference signal.

FIG. 1 schematically shows a general set-up including a system for determining a quality indicator representing a perceived quality of an output signal of an audio system, for example a speech processing device, with respect to a reference signal. Such method is meant to obtain an objective measure of the transmission quality of an audio system. The set-up includes an audio system 10 under investigation, e.g. a telecommunications network, network element or speech processing device in a network or mobile station. The set-up also includes a system 20 for measuring the transmission quality of the audio system, hereafter referred to as quality measurement system 20.

The quality measurement system 20 is arranged to receive two input signals. A first input signal is a speech signal X(t) that is directly provided to the quality measurement system 20 (i.e. not provided via the audio system 10), and serves as reference signal. The second input signal is a speech signal Y(t) which corresponds to the speech signal X(t) being affected by the audio system 10. The quality measurement system 20 provides an output quality signal Q which represents an estimate of the perceptual quality of the speech link through the audio system 10.

In this embodiment, the quality measurement system 20 comprises a pre-processing section 20*a*, a processing section 20*b*, and a signal combining section 20*c* to process the two input signals X(t), Y(t) such that the output signal Q can be provided.

The pre-processing section 20*a* comprises a pre-processing device 30 arranged to perform one or more pre-processing actions such as fixed level scaling and time alignment to obtain pre-processed signals $X_p(t)$ and $Y_p(t)$. Although FIG. 1 shows a single pre-processing device 30 it is also possible to have a separate pre-processing device for the speech signal X(t) and the speech signal Y(t).

The processing section 20*b* of the quality measurement system 20 is arranged to map the pre-processed signals onto representation signals according to a psycho-physical perception model of the human auditory system. Pre-processed signal $X_p(t)$ is processed in first processing device 40*a* to obtain representation signal R(X), while pre-processed signal $Y_p(t)$ is processed in second processing device 40*b* to obtain representation signal R(Y). First processing device 40*a* and second processing device 40*b* may be accommodated in a single processing device.

The signal combining section 20*c* of the quality measurement system 20 is arranged to combine the representation signals R(X), R(Y) to obtain a differential signal D by using a differentiation device 50. Finally, a modeling device 60 processes the differential signal D in accordance with a model in which certain properties of humans have been modeled to obtain the quality signal Q. The human properties, e.g. cognitive properties, may be obtained via subjective listening tests performed with a number of human subjects.

Pre-processing device 30, first processing device 40*a*, and second processing device 40*b* may form a processing system that may be used to perform embodiments of the invention as will be explained in more detail later. The processing system or components thereof may take the form of a hardware processor such as an Application Specific Integrated Circuit (ASIC) or a computer device for running computer executable code in the form of software or firmware. The computer device may comprise, e.g. a processor and a memory which is communicatively coupled to the processor. Examples of a memory include, but are not limited to, Read-Only Memory (ROM), Random Access Memory (RAM), Erasable Programmable ROM (EPROM), Electrically Erasable Programmable ROM (EEPROM), and flash memory.

The computer device may further comprise a user interface to enable input of instructions or notifications by external users. Examples of a user interface include, but are not limited to, a mouse, a keyboard, and a touch screen.

The computer device may be arranged to load computer executable code stored on a computer readable medium, e.g. a Compact Disc Read-Only Memory (CD ROM), a Digital Video Disc (DVD) or any other type of known computer-readable data carrier. For this purpose the computer device may comprise a reading unit.

The computer executable code stored on the computer readable medium, after loading of the code into the memory of the computer device, may be adapted to perform embodiments of the invention which will be described later.

Alternatively or additionally, such embodiments of the invention may take the form of a computer program product comprising computer executable code to perform such a method when executed on a computer device. The method may then be performed by a processor of the computer device after loading the computer executable code into a memory of the computer device.

Thus, an objective perceptual measurement method mimics sound perception of subjects in a computer program with the goal to predict the subjectively perceived quality of audio systems, such as speech codecs, telephone links, and mobile handsets. Physical signals of input and output of the device under test are mapped onto psychophysical representations that match as close as possible the internal representations inside the head of a human being. The quality of the device under test is judged on the basis of differences in the internal representation. The best known objective perceptual measurement method presently available is PESQ (Perceptual Evaluation of Speech Quality).

Figure 2:
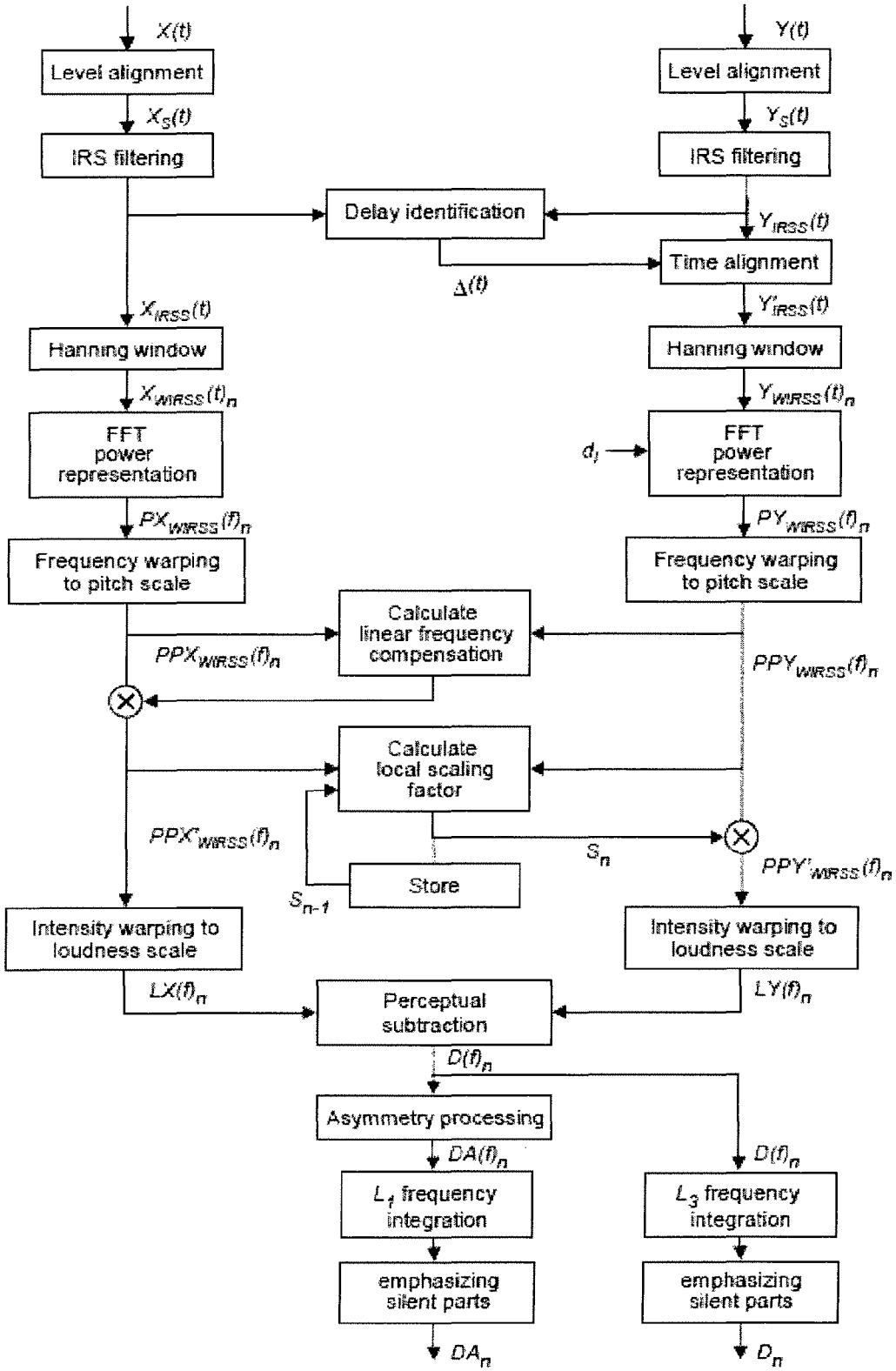
FIG. 2 schematically shows a method for determining a quality indicator representing a perceived quality of an output signal of an audio system, with respect to a reference signal according to PESQ.

FIG. 2 schematically shows a method for determining a quality indicator representing a perceived quality of an output signal of an audio system with respect to a reference signal according to PESQ as laid down in ITU-T Recommendation P.862, hereafter PESQ. PESQ can be used in a set-up as schematically shown in FIG. 1. In PESQ, a reference signal X(t) is compared with an output signal Y(t) that is the result of passing X(t) through an audio system, e.g. a speech processing system like a communication system. The output quality signal of PESQ, also referred to as PESQ score, is a prediction of the perceived quality that would be given to Y(t) by subjects in a subjective listening test. The PESQ score takes the form of a so-called mean opinion score (MOS). For this purpose the PESQ output is mapped onto a MOS-like scale, i.e. a single number in the range of −0.5 to 4.5, although for most cases the output range will be between 1.0 and 4.5, which is the normal range of MOS values found in an Absolute Category Rating (ACR) listening quality experiment.

Pre-processing in PESQ comprises level alignment of both signals X(t), Y(t) to obtain signals $X_s(t)$, $Y_s(t)$ respectively, as well as Intermediate Reference System (IRS) filtering to obtain signals $X_{IRSS}(t)$, $Y_{IRSS}(t)$ respectively. The level alignment involves scaling the intensity towards a fixed level, in PESQ 79 dB SPL. IRS filtering is performed to assure that the method of measuring the transmission quality is relatively insensitive to filtering of a telecommunications system element, e.g. a mobile telephone or the like. Finally, a time delay between reference signal $X_{IRSS}(t)$ and $Y_{IRSS}(t)$ is determined leading to a time-shifted output signal $Y_{IRSS}'(t)$. Comparison between reference signal and output signal is now assumed to take place with respect to the same time.

The human ear performs a time-frequency transformation. In PESQ, this is modeled by performing a short term Fast Fourier Transform (FFT) with a Hanning window on time signals $X_{IRSS}(t)$ and $Y_{IRSS}'(t)$. The Hanning window typically has a size of 32 ms. Adjacent time windows, hereafter referred to as frames, typically overlap by 50%. Phase information is discarded. The sum of the squared real and squared imaginary parts of the complex FFT components, i.e. the power spectra, are used to obtain power representations $PX_{WIRSS}(f)_n$ and $PY_{WIRSS}(f)_n$, where n denotes the frame under consideration. The power representations are divided in frequency bands, hereafter referred to as FFT-bands.

The human auditory system has a finer frequency resolution at low frequencies than at high frequencies. A pitch scale reflects this phenomenon, and for this reason PESQ warps the frequencies to a pitch scale, in this case to a so-called Bark scale. The conversion of the (discrete) frequency axis involves binning of FFT-bands to form Bark-bands, typically 24. The resulting signals are referred to as pitch power densities or pitch power density functions and denoted as $PPX_{WIRSS}(f)_n$ and $PPY_{WIRSS}(f)_n$. The pitch power density functions provide an internal representation that is analogous to the psychophysical representation of audio signals in the human auditory system, taking account of perceptual frequency.

To deal with filtering in the audio system to be tested, the power spectrum of the reference and output pitch power densities are averaged over time. A partial compensation factor is calculated from the ratio of the output spectrum to the reference spectrum. The reference pitch power density $PPX_{WIRSS}(f)_n$ of each frame n is then multiplied with this partial compensation factor to equalize the reference to the output signal. This results in an inversely filtered reference pitch power density $PPX'_{WIRSS}(f)_n$. This partial compensation is used because mild filtering is hardly noticeable while severe filtering can be disturbing to the listener. The compensation is carried out on the reference signal because the output signal is the one that is judged by the subject in an ACR listening experiment.

In order to compensate for short-term gain variations, a local scaling factor is calculated. The local scaling factor is then multiplied with the output pitch power density function $PPY_{WIRSS}(f)_n$ to obtain a locally scaled pitch power density function $PPY'_{WIRSS}(f)_n$.

After partial compensation for filtering performed on the reference signal and partial compensation for short-term gain variations performed on the output signal, the reference and degraded pitch power densities are transformed to a Sone loudness scale using Zwicker's law. The resulting two-dimensional arrays $LX(f)_n$, and $LY(f)_n$ are referred to as loudness density functions for the reference signal and the output signal respectively. For $LX(f)_n$ this means:

$$LX(f)_n = S_l\left(\frac{P_0(f)}{0.5}\right)^{\gamma}\cdot\left[\left(0.5+0.5\cdot\frac{PPX'_{WIRSS}(f)_n}{P_0(f)}\right)^{\gamma}-1\right] \quad (1)$$

where $P_0(f)$ is the absolute hearing threshold, $S_l$ the loudness scaling factor, and $\gamma$, the so-called Zwicker power, has a value of about 0.23. The loudness density functions represent the internal, psychophysical representation of audio signals in the human auditory system taking into account loudness perception.

Then the reference and output loudness density functions $LX(f)_n$, $LY(f)_n$ are subtracted resulting in a difference loudness density function $D(f)_n$. After the perceptual subtraction a perceived quality measure can be derived by taking both a disturbance measure D and an asymmetrical disturbance measure $D_A$ into account. Further details with respect to PESQ can be found in ITU-T Recommendation P.862.

Figure 3:
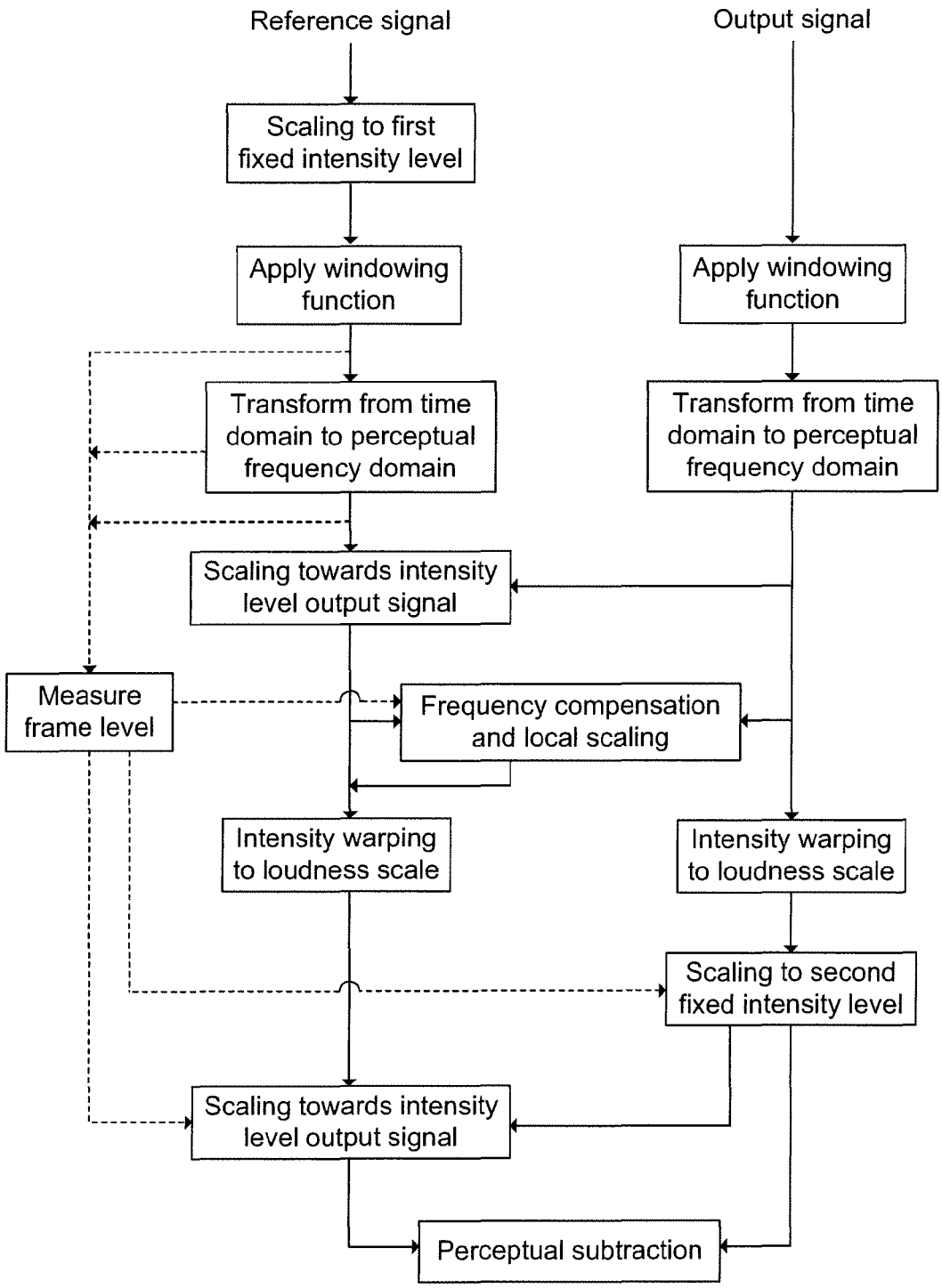
FIG. 3 schematically shows a method for determining a quality indicator representing a perceived quality of an output signal of an audio system with respect to a reference signal according to an embodiment of the invention.

FIG. 3 schematically shows a method for determining a quality indicator representing a perceived quality of an output signal of an audio system with respect to a reference signal according to an embodiment of the invention. After pre-processing actions like IRS-filtering and time delay, the reference signal and output signal are both transformed from signals in the time domain to signals in the perceptual time-frequency domain.

This may be accomplished in a way similar as shown in FIG. 2 with reference to PESQ. That is, first a windowing function, e.g. a Hanning window, is executed to divide the reference signal and the output signal in mutually corresponding time frames. Subsequently, an FFT is performed on the time frames to transform the signals from the time domain into the time-frequency domain. After the FFT, the signals are warped to a pitch scale, e.g. a frequency scale in Bark, to obtain a representation in the perceptual time-frequency domain, further referred to as perceptual frequency domain.

In contrast to the approach taken in PESQ as schematically shown in FIG. 2, the method schematically shown in FIG. 3 does take level variations into account, in particular so-called global play back level variations. By taking into account global play back level, the accuracy of the quality indicator may increase considerably, especially in those cases where the play back level does not match the standardized play back level used in calculations in accordance with ITU-T Recommendation P.862. That is, the correlation between the objectively obtained quality indicator and a subjectively obtained quality improves for applications where the global play back level is higher or lower than the standard level. Such different global play back level is often used in Voice-over-IP (VOIP) systems, for example to prevent acoustic feedback.

In order to be able to take intensity level variations into account, there is no level alignment action performed on the output signal in the pre-processing. However, as will be clarified below, it is desirable to obtain information with respect to the reference signal that is independent of global play back level. In other words, to obtain such information, the overall intensity level of the reference signal should be the same for all subjective tests for which one desires to make quality predictions.

For this reason, the reference signal is globally scaled towards a fixed intensity level. The scaling of the reference signal may be performed before the transformation, i.e. in the time domain, as schematically shown in FIG. 3. Alternatively, the reference signal may be scaled after transformation towards the (perceptual) time-frequency domain.

After scaling of the reference signal towards a fixed intensity level, measurements are performed on time frames within the scaled reference function to obtain reference signal characteristics. In particular, signal characteristics with respect to the intensity level of these time frames, e.g. the average intensity level or the peak intensity level therein, are determined based on the measurements performed.

After the frame level measurements, also referred to as frame level detection, the scaled reference signal is scaled towards an intensity level related to the output signal. Preferably, this scaling uses only frequency bands that are dominated by the speech signal, for example the bands between 400 and 3500 Hz. This scaling action is performed because as a result of the earlier scaling of the reference signal towards the fixed intensity level, the intensity level difference between reference signal and output signal can be such that obtaining a reliable quality indicator becomes impossible. The scaling of the scaled reference signal aims to create an intensity level difference between the scaled reference signal and the output signal that allows assessment of the impact of global play back level on the perceived quality. The performed scaling action thus partially compensates for the intensity level difference between the scaled reference signal and the output signal. Level differences exceeding a certain threshold value may not be fully compensated allowing to model the impact of overall low presentation level, e.g. someone sets the volume of his playback device to a low intensity level. Low level speech playback is commonly used in VOIP-systems, e.g. to deal with breakdown in acoustic echo control.

The scaling may use a soft scaling algorithm, i.e. an algorithm that scales the signal to be treated in such a way that small deviations of power are compensated, preferably per time frame, while larger deviations are compensated partially, in dependence on a power ratio between the reference signal and the output signal. More details with respect to the use of soft scaling can be found in US-patent application 2005/159944, U.S. Pat. No. 7,313,517, and U.S. Pat. No. 7,315,812, all assigned to the applicant and herewith incorporated by reference.

After the global scaling action, the reference signal may be subjected to frequency compensation as described with reference to FIG. 2. Similarly, the output signal may be subjected to a local scaling action. The local scaling may also be performed with respect to the reference signal as schematically shown in FIG. 3. Both the reference signal and the output signal are then subjected to intensity warping to the loudness scale as discussed with reference to PESQ shown in FIG. 2. The reference signal and output signal are now represented in the perceptual loudness domain.

In the perceptual loudness domain, in contrast to PESQ shown in FIG. 2, both the output signal and the reference signal are subject to a further scaling action. Up to this point, signal levels of the output signal have not been changed significantly, and very low levels of the output signal will now cause only marginal differences in the internal representation. This leads to errors in the quality estimation.

For this purpose, first, the output signal is scaled to a fixed loudness level. The fixed loudness level may be determined by calibration experiments performed in subjective listening quality experiments. If a starting global level calibration is used for the reference signal as described in the ITU-T Recommendations P.861 and/or P.862, such fixed loudness level lies around 20, a dimensionless internal loudness related scaling number.

As a result of the loudness level scaling of the output signal, the loudness level difference between the output signal and the reference signal is such that no reliable quality indicator can be determined. To overcome this undesirable prospect, the loudness level of the reference signal needs to be scaled as well. Therefore, following the scaling of the loudness level of the output signal, the loudness level of the reference signal is scaled towards a loudness level related to the scaled output signal. Now both the reference signal and the output signal have a loudness level that can be used to calculate the perceptually relevant internal representations needed to obtain an objective measure of the transmission quality of an audio system.

In the global scaling actions performed in the perceptual loudness domain, the average loudness of both reference and output signals may be used. The average loudness of these signals may be determined over time frames for which the intensity level in the reference signal as measured during the frame level detection exceeds a further threshold value, e.g. the speech activity criterion value. The speech activity criterion value may correspond to an absolute hearing threshold. If the speech activity criterion value is used, these frames may be referred to as speech frames. For the output signal, for calculation purposes, the time frames corresponding to time frames for which the intensity level exceeds the further threshold value, are taken into account. Thus, in an embodiment using the speech activity criterion value, the average loudness of the reference signal is determined with respect to speech frames, while the average loudness of the output signal is determined with respect to time frames corresponding to the speech frames within the reference signal.

In FIG. 3, finally, the reference signal and output signal are perceptually subtracted. This can be done in a way known from PESQ and discussed with reference to FIG. 2. That is, an indicator representative of the overall degradation, $D_n$, and an indicator representative of added degradations, $DA_n$, are determined in parallel.

The scheme as shown in FIG. 3 allows for a different approach regarding calculation of both indicators $D_n$, $DA_n$. It is possible to perform the method as shown in FIG. 3 twice, i.e. one time for determining a quality indicator representing quality with respect to the overall degradation, the other time for determining a quality indicator representing quality with respect to degradations added in comparison to the reference signal. Performing the method twice enables optimization of calculations with respect to different types of distortions. Such optimization may considerably improve the correlation between an objectively measured speech quality and a speech quality as obtained in subjective listening quality experiments.

In an embodiment where the method is performed twice, results of the frame level detection may be used differently. For example, the selection of time frames may be different, e.g. based on different speech activity threshold values.

Figure 4:
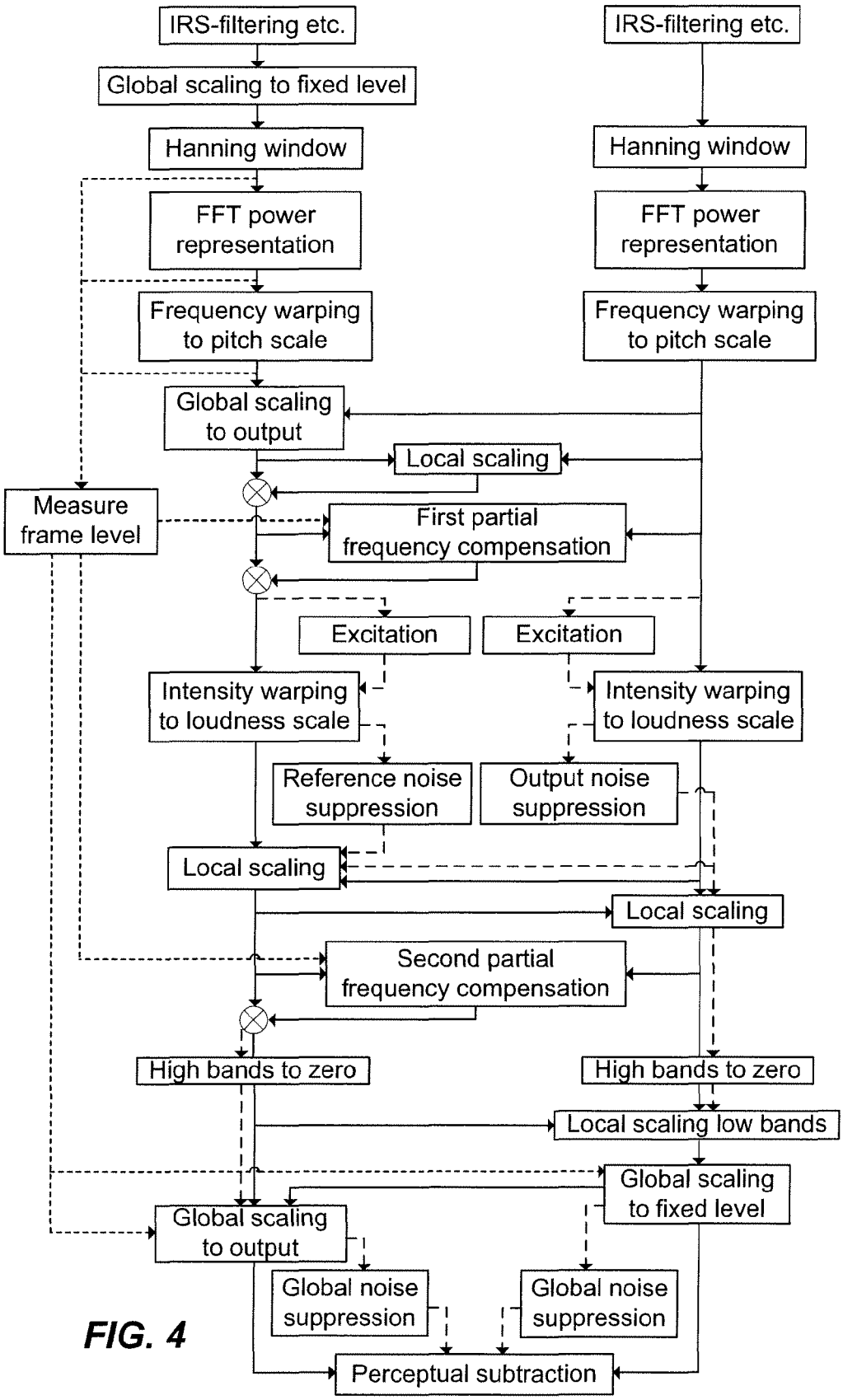
FIG. 4 schematically shows a method for determining a quality indicator representing a perceived quality of an output signal of an audio system with respect to a reference signal according to a further embodiment of the invention.

FIG. 4 schematically shows a method for determining a quality indicator representing a perceived quality of an output signal of an audio system with respect to a reference signal according to a further embodiment of the invention. In this method, both the reference signal and the output signal undergo pre-processing steps, for example IRS-filtering and time delay as known from PESQ and described with reference to FIG. 2. Before obtaining a time-frequency representation of the signals by means of performing a short fast Fourier transform in combination with the use of a windowing function, e.g. a Hanning window as known from PESQ, the reference signal is globally scaled to a fixed level. The global scaling towards a fixed level is similar to the level alignment used in PESQ. However, in this case only the reference signal is scaled in this way. The output signal is not scaled at this stage. The fixed level preferably coincides with a level of about 73 dB SPL for a diotically or dichotically presented speech fragment and with a level of about 79 dB SPL for a monotically presented speech fragment. The output signal is scaled with a factor in such a manner that the internal representation corresponds to the actual acoustic level used in the subjective test.

After obtaining the power-frequency representation due to the FFT performed on a time window selected via a windowing function, e.g. a Hanning window, the reference signal is scaled towards the output signal on a global level with an algorithm that only partially compensates for the intensity level difference between the reference signal and the output signal. The difference that is left can be used to estimate the impact of intensity level on perceived transmission quality.

In an embodiment, the scaling of the intensity of the reference signal from the fixed intensity level towards an intensity level related to the output signal may be based on multiplication of the reference signal with a scaling factor. Such scaling factor may be derived by determining average signal intensity level for at least part of the reference and output signals. The average reference signal intensity level and the average output signal intensity level may then be used in a fraction calculation to obtain a preliminary scaling factor. Finally, the scaling factor may be determined by defining the scaling factor to be equal to the preliminary scaling factor if the preliminary scaling factor is smaller than a threshold value, and, being equal to the preliminary scaling factor incremented with an additional preliminary scaling factor dependent value otherwise.

After the global scaling towards the intensity level of the output signal, the reference signal is subject to a local scaling in the perceptual time-frequency domain and a partial frequency compensation using the same approach as discussed with reference to PESQ in FIG. 2. Although in the embodiment shown in FIG. 4 the local scaling is performed with reference to the reference signal, it is equally well possible to apply this local scaling step with respect to the output signal, e.g. in a way as shown in FIG. 2. The object of the local scaling action relates to compensation of short-term gain variations. Whether the reference signal or the output signal is to be selected may depend on the specific application. In general, the reference signal is compensated, because the reference signal is generally not presented to a test subject in subjective quality measurements.

In an embodiment, the first partial frequency compensation uses a so-called soft scaling algorithm. In the soft scaling algorithm, the signal to be treated, i.e. either the reference signal or the output signal, is improved by scaling in such a way that small deviations of power are compensated, preferably per time frame, while larger deviations are compensated partially, in dependence on a power ratio between the reference signal and the output signal. More details with respect to the use of soft scaling can be found in US-patent application 2005/159944, U.S. Pat. No. 7,313,517, and U.S. Pat. No. 7,315,812, all assigned to the applicant and herewith incorporated by reference.

Preferably, an excitation step is now performed on both the reference signal and the output signal to compensate for smearing of frequency components as a result of the earlier execution of the fast Fourier transform with a windowing function, e.g. a Hanning window, with respect to these signals. The excitation step is performed by using a self masking curve to sharpen the representation of both signals. More details with respect to the calculation of such self masking curve can for example be found in the article "A perceptual Audio Quality Measure Based on a Psychoacoustic Sound Representation", by J. G. Beerends and J. A. Stemerdink, J. Audio Eng. Soc., Vol. 40, No. 12 (1992) pp. 963-978. In this article, the excitation is calculated and quality is determined by using smeared excitation representations. In an embodiment, the calculated excitation is then used to derive a self masking curve that in its turn can be used to get a sharpened time-frequency representation. In its simplest form, the self masking curve corresponds to a fraction of the excitation curve.

After an intensity warping to loudness scale as used in PESQ, and described with reference to FIG. 2, the reference signal and the output signal are scaled locally in the loudness domain. Firstly, those parts of the reference signal are scaled that are louder than the output signal. Then portions of the output signal that are louder than the reference signal are scaled.

The separation of these local scaling actions allows for separate implementation and/or manipulation of level variations due to time clipping and pulses. If a portion of the reference signal is louder than a corresponding portion of the output signal, this difference may be due to time clipping, e.g. caused by a missing frame. In order to quantify the perceptual impact of time clipping, the reference signal is scaled down to a level that is considered to be optimal for the (asymmetric) disturbance difference calculation. This local scaling action on the output signal also suppresses noise in the output signal up to a level that is more optimal for the (asymmetric) disturbance difference calculation. The impact of noise on the subjectively perceived quality can be more accurately estimated by combining this local scaling with a noise suppression action on the output signal.

Next, a second partial frequency compensation may be carried out. This frequency compensation may be performed in a similar way as in PESQ, however, now being used in the loudness domain. In an embodiment, the second partial frequency compensation uses a soft scaling algorithm as discussed earlier with reference to the first partial frequency compensation. It has been found that the use of a second partial frequency compensation further improves the correlation between an objectively measured speech quality and the speech quality as obtained in subjective listening quality experiments.

As described earlier, the first partial frequency compensation and the second partial frequency compensation may be similar to the partial frequency compensation used in PESQ, as discussed with reference to FIG. 2. Therefore, these frequency compensation actions may use an averaging operation. comprising an estimation of linear frequency response of the system under test based. In some embodiments, the estimation is only performed on frames for which the reference signal intensity level value is larger than a threshold value, for example the speech activity criterion value. As will be readily understood from the scheme of FIG. 4, such selection of speech frames may be based on the detected levels at the frame level detection action.

Preferably, at this point, high bands of both reference signal and output signal are set to zero because they turn out to have a negligible influence on the perceived transmission quality to be determined. Additionally, the intensity levels of the low bands of the output signal are locally scaled towards the intensity levels of similar bands of the reference signal. For example, all bands related to Bark 23 and higher may be set to zero, while Bark bands in the output signal related to Bark 0 to 5 may be scaled. Bark bands related to Bark 0-22 in the reference signal and Bark bands related to Bark 6 to 22 in the output signal are then not subject to either one of these operations.

Up to this point, signal levels of the output signal have not been changed significantly, and very low levels of the output signal will now cause only marginal differences in the internal representation. This leads to errors in the quality estimation. Therefore, both the reference signal and the output signal are globally scaled towards a level that can be used to calculate the perceptually relevant internal representations needed to obtain an objective measure of the transmission quality of an audio system. Firstly, the global level of the output signal is scaled towards a fixed internal loudness level. If a starting global level calibration is used for the reference signal as described in the ITU-T Recommendations P.861 and/or P.862, such fixed global internal level lies around 20, a dimensionless internal loudness related scaling number. Secondly, the levels of the reference signal are scaled towards the corresponding levels of the output signal in a similar way and for the same reasons as discussed with reference to FIG. 3.

Finally, similarly to the method described with reference to FIG. 2, the reference signal and output signal are subtracted resulting in a difference signal. After the perceptual subtraction, a perceived quality measure can be derived, e.g. in a way as shown in FIG. 2 and described in ITU-T Recommendation P.862.

Alternatively, the method is performed twice. One time to determine a quality indicator representative of the quality with respect to overall degradation in comparison to the reference signal, and the other time to determine a quality indicator representative of the quality with respect to degradations added in comparison to the reference signal.

In some embodiments of the invention, the method further includes one or more steps of noise suppression. The impact of noise on the transmission quality of an audio system, in particular the speech quality, is dependent on local level and/or local spectral changes. In PESQ, this effect is not taken into account correctly. PESQ only uses the local power level per frame to suppress the noise to a level that approximately quantifies the impact of noise. The one or more steps of noise suppression may provide a significant improvement in predicting the transmission quality of an audio system.

In an embodiment, such noise suppression is performed on the reference signal after the intensity warping to the Sone loudness scale. This noise suppression action may be arranged for suppressing noise up to a predetermined noise level. The predetermined noise level then may correspond to a noise level that is considered to be a desirable low noise level to serve as an ideal representation for the output signal.

Similarly, in an embodiment, such noise suppression is performed on the output signal after intensity warping to the Sone loudness scale. In this case, the noise suppression action may be arranged for suppressing noise up to a noise level representative of the disturbance experienced by the device under test, e.g. audio system 10 in FIG. 1.

In some other embodiments, the reference signal and the output signal further undergo an additional noise suppression action after global scaling as schematically shown in FIG. 3 by the dashed line. It has been found that such additional noise suppression after global scaling further improves the correlation between an objectively measured speech quality and the speech quality as obtained in subjective listening quality experiments.

In some embodiments that use one or more steps of noise suppression, the determined intensity level parameters of the time frames within the scaled reference signal are used to select time frames within the output signal to be included in the one or more of the noise suppression calculations. For example, time frames within the scaled reference signal may be selected for calculation based on their intensity value being below a certain threshold value, for example silence criterion value. A time frame within the scaled reference signal for which the intensity value lies below the silence criterion value may be referred to as silent frame. Selected time frames within the output signal then correspond to the silent frames within the scaled reference signal. Preferably, such selection process progresses by identifying a series of consecutive silent frames, e.g. 8 silent frames. Such series of consecutive silent frames may be referred to as a silent interval. The measured intensity level within silent frames, and in particular silent frames within a silent interval, expresses a noise level that is inherently present in the reference signal under consideration. In other words, there is no influence of the device under test.

The invention has been described by reference to certain embodiments discussed above. It will be recognized that these embodiments are susceptible to various modifications and alternative forms well known to those of skill in the art.

The invention claimed is:

1. A method for determining a quality indicator representing a perceived quality of an output signal of an audio system with respect to a reference signal, where the reference signal and the output signal are processed and compared, and the processing includes dividing the reference signal and the output signal into mutually corresponding time frames, wherein the processing further comprises:

scaling the intensity of the reference signal towards a fixed intensity level;

performing measurements on time frames within the scaled reference signal for determining reference signal time frame characteristics;

scaling the intensity of the reference signal from the fixed intensity level towards an intensity level related to the output signal;

scaling the loudness of the output signal towards a fixed loudness level in the perceptual loudness domain, the output signal loudness scaling using the reference signal time frame characteristics; and scaling the loudness of the reference signal from a loudness level corresponding to the output signal related intensity level towards a loudness level related to the loudness level of the scaled output signal in the perceptual loudness domain, the reference signal loudness scaling using the reference signal time frame characteristics.

2. The method of claim 1, wherein scaling the intensity of the reference signal from the fixed intensity level towards an intensity level related to the output signal is based on multiplication of the reference signal with a scaling factor, the scaling factor being defined by:

determining an average reference signal intensity level for a number of time frames;

determining an average output signal intensity level for a number of time frames corresponding to the time frames of the reference signal used to determine the average reference signal intensity level;

deriving a preliminary scaling factor by determining a fraction based on the average reference signal intensity level and the average output signal intensity level; and determining a scaling factor by defining the scaling factor to be equal to the preliminary scaling factor if the preliminary scaling factor is smaller than a threshold value, and, being equal to the preliminary scaling factor incremented with an additional preliminary scaling factor dependent value otherwise.

3. The method of claim 1, wherein the method, before the loudness scaling of the output level to a fixed loudness level, further comprises:

locally scaling the loudness level of the reference signal towards the loudness level of the output signal for parts of the reference signal with a loudness level being higher than the loudness level of the output signal; and subsequently locally scaling the loudness level of the output signal towards the loudness level of the reference signal for parts of the output signal with a loudness level being higher than the loudness level of the reference signal.

4. The method of claim 3, wherein at least one of compensating the locally scaled reference pitch power density function with respect to frequency and compensating the locally scaled reference loudness density function includes estimating a linear frequency response of the speech processing system based on the reference signal time frame characteristics.

5. The method of claim 1, wherein the processing further comprises:

transforming the scaled reference signal and the output signal from the time domain towards the time-frequency domain;

deriving a reference pitch power density function from the reference signal, and deriving an output pitch power density function from the output signal, said intensity level difference corresponding to the difference between the intensity levels of the pitch power density functions;

locally scaling the reference pitch power density function to obtain a locally scaled reference pitch power density function;

partially compensating the locally scaled reference pitch power density function with respect to frequency; and deriving a reference loudness density function and an output loudness density function, said loudness level difference corresponding to the difference between the loudness levels of the loudness density functions;

wherein the loudness density functions represent density functions that enable quantification of the impact of variable level playback on perceived quality.

6. The method of claim 5, further comprising performing an excitation operation on at least one of the reference pitch power density function and the output pitch power density function.

7. The method of claim 1, wherein the reference signal in the perceptual loudness domain, before the scaling towards a loudness level related to the loudness level of the output signal in the perceptual loudness domain, is subjected to a noise suppression action for suppressing noise up to a predetermined noise level.

8. The method of claim 1, wherein the output signal in the perceptual loudness domain, before the scaling towards a fixed loudness level, is subjected to a noise suppression algorithm for suppressing noise up to a noise level representative of disturbance.

9. The method of claim 1, wherein the reference signal and the output signal in the perceptual loudness domain, before comparison, are subjected to a global noise suppression.

10. A non-transitory computer readable medium having stored thereon software instructions that, if executed by a processor, cause the processor to perform operations comprising the method steps according to claim 1.

11. A system for determining a quality indicator representing a perceived quality of an output signal of an audio system, with respect to an input signal of the audio system which serves as a reference signal, the system comprising:

a pre-processing device for pre-processing the reference signal and the output signal;

a first processing device for processing the reference signal, and a second processing device for processing the output signal to obtain representation signals for the reference signal and the output signal respectively;

a differentiation device for combining the representation signals of the reference signal and the output signal so as to obtain a differential signal; and a modeling device for processing the differential signal to obtain a quality signal representing an estimate of the perceptual quality of the speech processing system, wherein the pre-processing device, the first processing device, and the second processing device form a processing system configured to perform the method of claim 1.

* * * * *